US005782274A

United States Patent [19]

Kaneko et al.

[11] Patent Number: 5,782,274

[45] Date of Patent: Jul. 21, 1998

[54] ELLIPTICAL CLEANING BOX FOR FILLING APPARATUS

[75] Inventors: Yutaka Kaneko, Wheeling; Bengt Andersson, Palatine, both of Ill.

[73] Assignee: Tetra Laval Holdings & Finance, SA, Pully, Switzerland

[21] Appl. No.: 816,056

[22] Filed: Mar. 11, 1997

[51] Int. Cl.[6] ..... B65B 3/04

[52] U.S. Cl. ..... 141/90; 141/91; 141/370

[58] Field of Search ..... 141/89–91, 236, 141/237, 370, 372, 374

[56] References Cited

U.S. PATENT DOCUMENTS

| | | | |
|---|---|---|---|
| 3,716,083 | 2/1973 | Tuma et la. | 141/90 |
| 3,785,410 | 1/1974 | Carter | 141/10 |
| 4,534,494 | 8/1985 | Hautemont | 222/148 |
| 4,579,156 | 4/1986 | Graffin | 141/89 |
| 4,718,465 | 1/1988 | Dugan | 141/89 |
| 4,905,871 | 3/1990 | Dutertre | 222/83 |
| 4,964,444 | 10/1990 | Hanérus et al. | 141/90 |
| 4,987,934 | 1/1991 | Groom | 141/89 |
| 5,095,958 | 3/1992 | Tincti | 141/91 |
| 5,226,863 | 7/1993 | Kimura | 141/89 |
| 5,267,591 | 12/1993 | Wakabayashi et al. | 141/90 |
| 5,524,392 | 6/1996 | Franke et al. | 141/89 |
| 5,531,253 | 7/1996 | Nishiyama et al. | 141/90 |
| 5,533,550 | 7/1996 | Franke et al. | 141/90 |
| 5,533,552 | 7/1996 | Ahlers | 141/144 |
| 5,562,129 | 10/1996 | Graffin | 141/90 |
| 5,687,779 | 11/1997 | Andersson et al. | 141/90 |

*Primary Examiner*—J. Casimaer Jacyna
*Attorney, Agent, or Firm*—Michael A. Catania

[57] ABSTRACT

A cleaning box for a liquid food product filling apparatus includes a mounting member from which the plurality of filling tubes depend, and a hollow, shroud-like elliptical cylindrical body extending from the mounting member. The cleaning box is configured to, in part, shroud the filling tubes. The elliptical cylindrical body has a longitudinal axis, and is mounted to the mounting member so as to define an elliptical juncture therebetween. The elliptical cylindrical body terminates at about a free end of the filling tubes so as to define an opening. The opening is formed at an angle relative to the longitudinal axis so as to define a circular end profile. The opening is further formed such that the filling tubes are visually perceptible from a plane perpendicular to the longitudinal axis.

2 Claims, 5 Drawing Sheets

ELLIPTICAL CLEANING BOX FOR FILLING APPARATUS

FIELD OF THE INVENTION

This invention relates to a cleaning box for a liquid filling apparatus. More particularly, the invention relates to an elliptically shaped, angled opening cleaning box for a liquid filling apparatus.

BACKGROUND OF THE INVENTION

Liquid filling apparatuses are used in a wide variety of industries for a wide variety of applications. Such apparatuses are extensively used, in particular, in the liquid food packaging industry for, for example, filling liquid food packages, such as milk cartons, juice boxes and the like.

Generally, a liquid food packaging system includes a liquid reservoir or tank for bulk storage of the liquid food, and liquid transfer means for transferring the bulk liquid to individual packages. In a typical arrangement, the liquid transfer means includes a series of pumps, liquid conduits and valves to supply the liquid food to a filling station. The filling station includes a flexible delivery or filling nozzle. The flexible filling nozzle introduces the liquid into the individual packages.

The filling nozzle is mounted to the end of a rigid filling tube. The flexible nozzle can have an open square cross-sectional shape to match the shape of the containers or cartons being filled. In a common arrangement, the filling tube extends downwardly and depends from a mounting plate that is mounted or affixed to the filling apparatus. In an arrangement in which the filling apparatus is used for filling cartons, such as commonly recognizable gable top cartons, the apparatus can include guide elements positioned adjacent to the filling tubes. The guide elements facilitate locating the carton under the nozzle and properly positioning the nozzle within the carton.

The nature of the food packaging industry requires that packaging systems are maintained at high levels of cleanliness. As such, it is important that the components of such systems are configured to facilitate inspection and periodic cleaning and maintenance of the equipment and systems.

One device that is used in conjunction with or as part of the filling apparatus is a cleaning box. In one known cleaning box configuration, a circular tube extends downwardly over, and shrouds a single filling tube and nozzle to provide an isolatable area within which the tube and nozzle can be cleaned. While this arrangement is satisfactory for cleaning the filling tube and nozzle, a number of drawbacks have been observed. First, the cleaning box completely surrounds the nozzle. Thus, access to the tube and nozzle is inhibited, which can prevent readily inspecting the tube and nozzle to determine the integrity or condition thereof.

In addition, the circular cleaning box can accommodate only a single filling nozzle. Moreover, not all types of cartons can be filled by a filling apparatus having a circular cleaning box. In particular, gable top cartons that use plastic spouts extending from the gable, may not properly fit into the cleaning box and onto the nozzle.

Another known cleaning box configuration includes an elongated, rectangular box having square, machined openings in the bottom thereof. The rectangular cleaning box has between about 6 and 12 filling nozzles positioned therein. The cartons are inserted upwardly into the box to engage the nozzles, and subsequently to be filled.

While the rectangular cleaning box provides an isolatable region configured to accommodate a plurality of nozzles, the cost to manufacture a machined, rectangular box can be prohibitive. Moreover, because of the shape and size of the box, not all types of cartons can be filled using the filling apparatus. As with the circular cleaning box, gable top cartons may not properly fit through the machined openings. In addition, similar to the circular cleaning box, the filling tubes and nozzles are completely enclosed within the rectangular box and are thus not readily accessible for cleaning, maintenance and inspection.

With both the rectangular cleaning box and the circular cleaning box, inspection, cleaning and maintenance of the filling tubes and nozzles can require that one or more major portions of the apparatus be disassembled in order to access the appropriate areas within the equipment.

Accordingly, there continues to be a need for a cleaning box for a filling apparatus that provides a fully isolatable region, and which cleaning box is configured to accommodate a plurality of filling nozzles. Such a cleaning box further permits ready access to the nozzle for cleaning, maintenance and visual inspection without disassembly of a major portion of the apparatus.

SUMMARY OF THE INVENTION

A cleaning box for use with an associated liquid food product filling apparatus includes an elliptical cylindrical body having an angled open end. The cleaning box is configured for use with a filling apparatus having at least one, and preferably a pair, of depending elongated filling tubes. The cleaning box has a mounting member from which the filling tubes depend. The elliptical cylinder provides a shroud-like enclosure for the filling tubes and extends from the mounting member so as to define, in part, a shroud for the filling tubes.

The elliptical cylinder has a longitudinal axis, and is mounted to the mounting member so as to define an elliptical juncture therebetween. The elliptical cylinder terminates so as to define an opening being formed at an angle relative to the longitudinal axis. The opening defines a predetermined end profile and is configured such that the filling tubes are visually perceptible from a plane perpendicular to the longitudinal axis at about the opening.

In a preferred embodiment, the opening end profile scribes a circle in the plane of the opening, and the plane angle is formed at an angle of 45° relative to the longitudinal axis.

Optionally, the cleaning box can include a sealed closure cap which, when engaged with the cleaning box, provides an isolated environment for cleaning the filling tubes and filling nozzles. The cleaning box can include one or more nozzles, for, for example, supplying cleaning fluids, such as water, acids, alkali, disinfectants, detergents and the like, to the cleaning box, and for draining the fluids therefrom. The cleaning box can also include a spray nozzle for directing cleaning fluid between the filling tubes. In a preferred arrangement, the drain nozzle and closure cap are each configured having a downward slope or pitch to effect drainage. The inlet nozzle can be tangentially mounted to the cleaning box to impart a swirling motion to the inlet cleaning fluid.

Other features and advantages of the present invention will be apparent from the following detailed description, the accompanying drawings, and the appended claims.

DETAILED DESCRIPTION OF THE PREFERRED EMBODIMENTS

Figure 1:
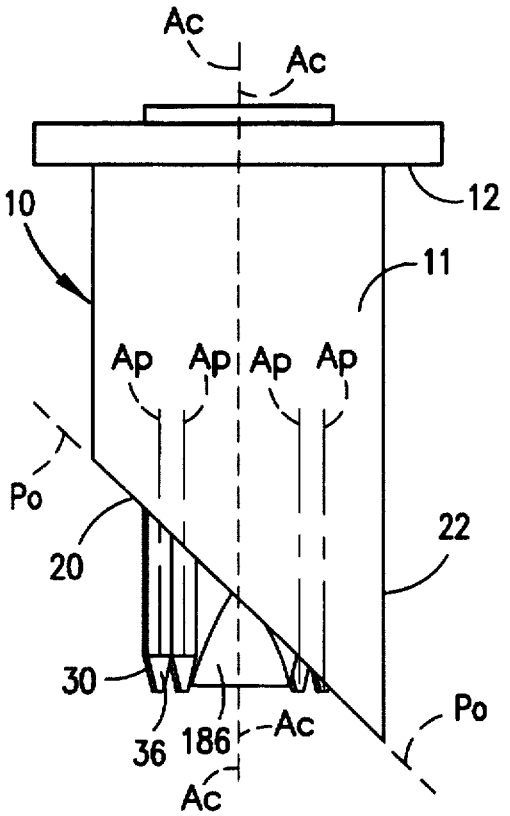
FIG. 1 is a side plan view of an elliptical cleaning box embodying the principles of the present invention, the cleaning box having an angled open end, and showing a filling tube extending therefrom.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Figure 2:
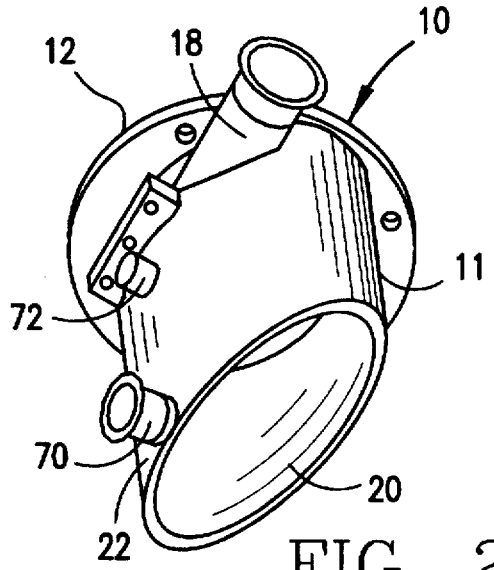
FIG. 2 is a bottom perspective view of the cleaning box of FIG. 1, the cleaning box being shown without filling nozzles for clarity of illustration, and further illustrated with inlet, spray and drain nozzles extending therefrom.
Figure 3:
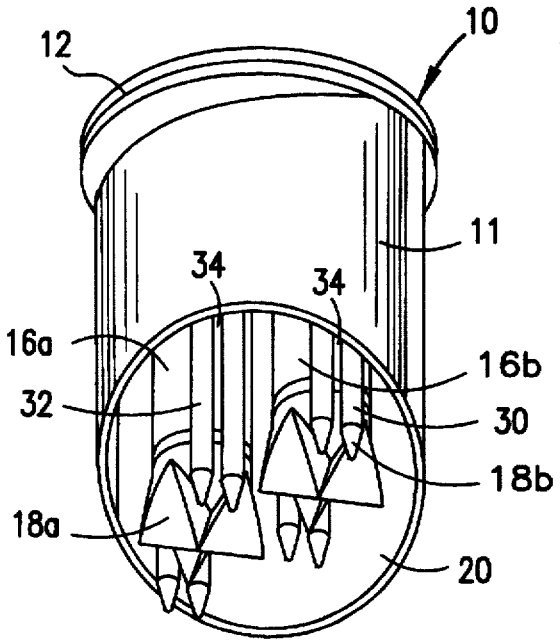
FIG. 3 is a bottom-side perspective view of the cleaning box of FIG. 1, illustrating a pair of filling tubes and nozzles positioned therein.
Figure 4:
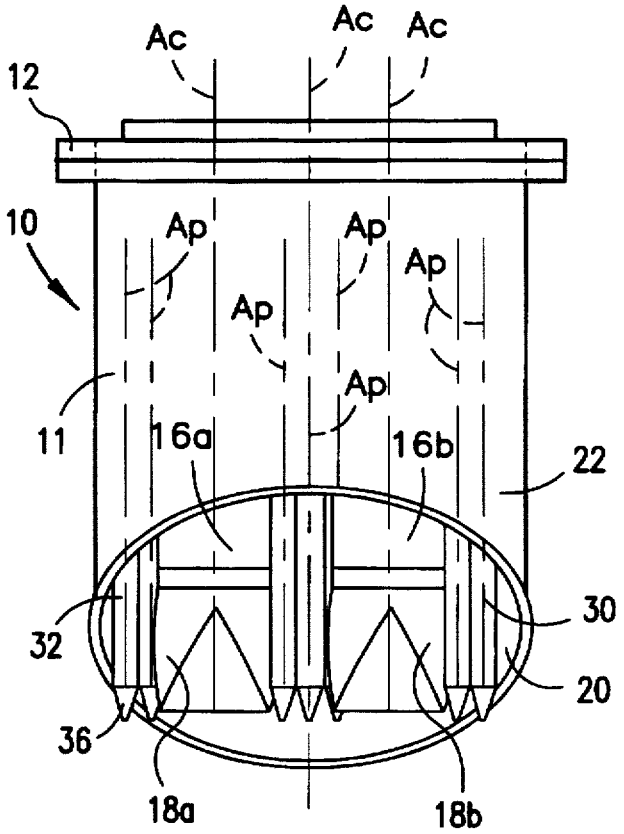
FIG. 4 is a front plan view of the cleaning box of FIG. 1.

Referring now to the figures, and in particular to FIGS. 1 and 2, there is shown an elliptical cleaning box 10 in accordance with the principles of the present invention. The cleaning box 10 includes an elliptical cylindrical body portion 11 that is mounted to a mounting plate 12 that is in turn mounted to a filling apparatus 14, as shown in FIGS. 7 and 12*a–c*. The cleaning box 10 is configured to enclose and shroud, in part, one or more filling tubes 16 and nozzles 18. In a preferred embodiment, as illustrated in FIGS. 3 and 4, the cleaning box 10 has two filling tubes 16*a,b* positioned therein. The filling tubes 16*a,b* each have a filling nozzle 18*a,b* mounted to the end of the respective filling tubes 16*a,b*.

The body portion 11 is an elliptical, shroud-like, hollow, cylindrical member that depends from and is mounted to the mounting plate 12. As is readily apparent from the figures, and particularly FIGS. 3–6, the elliptical shape of the body 11 provides a number of advantages over known circular and square profile cleaning boxes.

First, relative to known circular boxes, the elliptically shaped body 11 provides sufficient cross-sectional area to shroud a plurality of, for example two, filling tubes 16*a,b*, in a single cleaning box 10. This reduces the overall costs for the equipment by reducing the total number of cleaning boxes required for each filling apparatus. In addition, as illustrated in FIG. 5, the cleaning box 10 can be configured to accommodate cartons C having injection molded spouts S, such as the threaded, plastic spouts S commonly found on gable top cartons C.

Unlike rectangular boxes, the elliptical cleaning box 10 does not require corner welds. Such corner welds greatly increase the cost to manufacture the cleaning box because of the precautions necessary to prevent warpage and bending due to the extreme heat of welding. In addition, unlike rectangular boxes, the elliptical cleaning box 10 can accommodate gable top cartons C having plastic spouts S mounted to the carton C gable.

Figure 5:
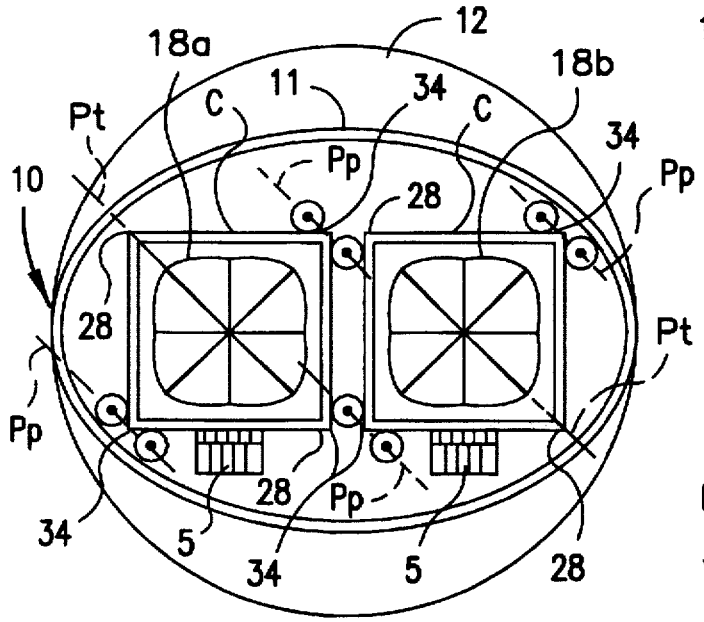
FIG. 5 is a bottom view of the cleaning box of FIG. 1, illustrating the elliptical profile of the cleaning box, the box being shown with a pair of cartons engaged with the filling nozzles.
Figure 7:
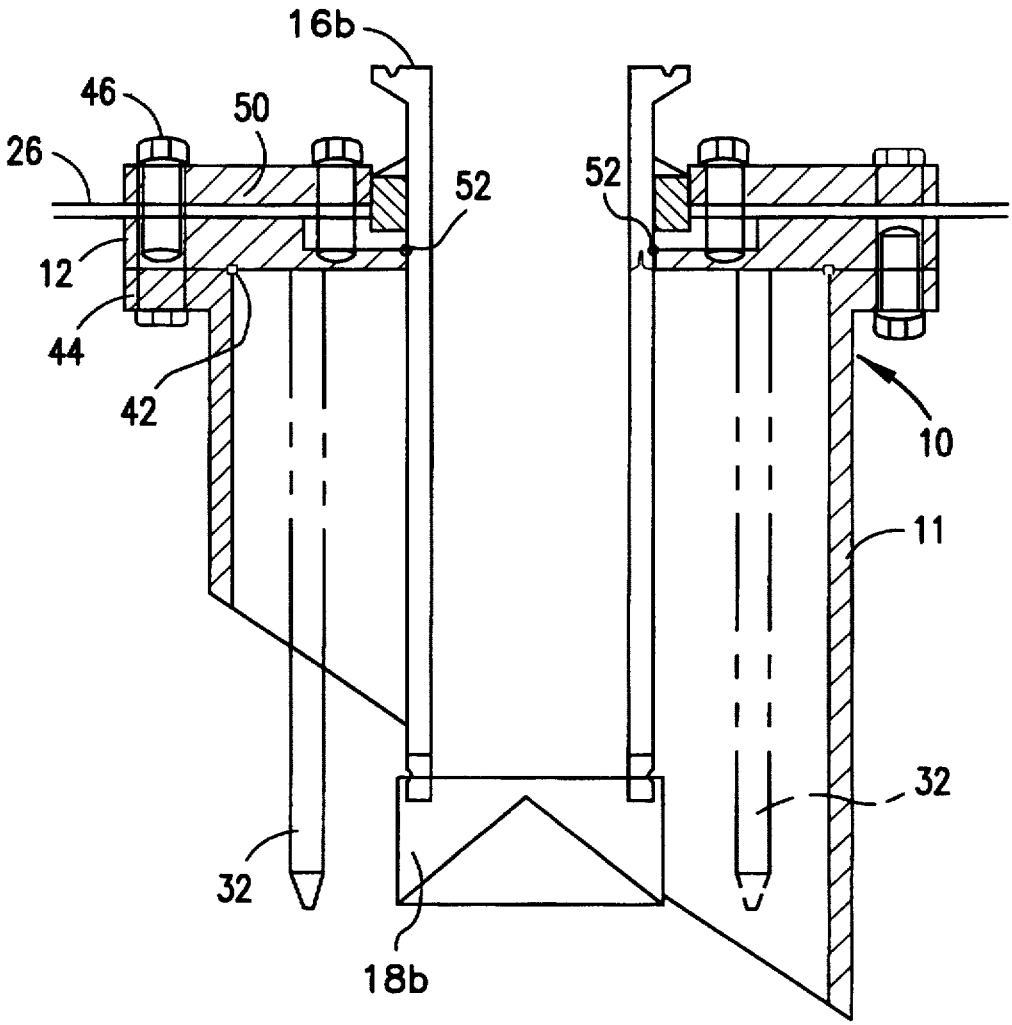
FIG. 7 is a partial cross-sectional view of the cleaning box of FIG. 1, illustrated with a mounting plate and shown with a filling tube and associated guide pins mounted to the mounting plate.

FIGS. 5 and 7 illustrate side views of the cleaning box 10. The cleaning box 10 has an angled bottom opening 20 therein defining a plane $P_o$ across the opening 20. In a preferred configuration, a portion of each filling tube 16*a,b* and nozzle 18*a,b* is exposed at the bottom 22 of the box 10. That is, a portion of the nozzles 18*a,b* and tubes 16*a,b* cross the plane $P_o$ defined by the opening 20. Advantageously, the angled opening 20 of the present cleaning box 10 permits readily visually inspecting the filling nozzles 18*a,b*, and further permits routine maintenance, e.g., nozzle replacement, without disassembly of one or more major portions of the apparatus 14. In that the nozzles 18*a,b* are typically formed of a commercial, food grade, flexible rubber material that can become damaged during the automated filling operation, ready inspection of the filling nozzles 18*a,b* provides a significant improvement over known cleaning boxes that do not provide such visual inspection capability. Advantageously, providing a configuration that permits readily visually inspecting the nozzles can save significant time and cost during filling machine 14 inspection and maintenance and can greatly reduce equipment downtime.

Figure 6:
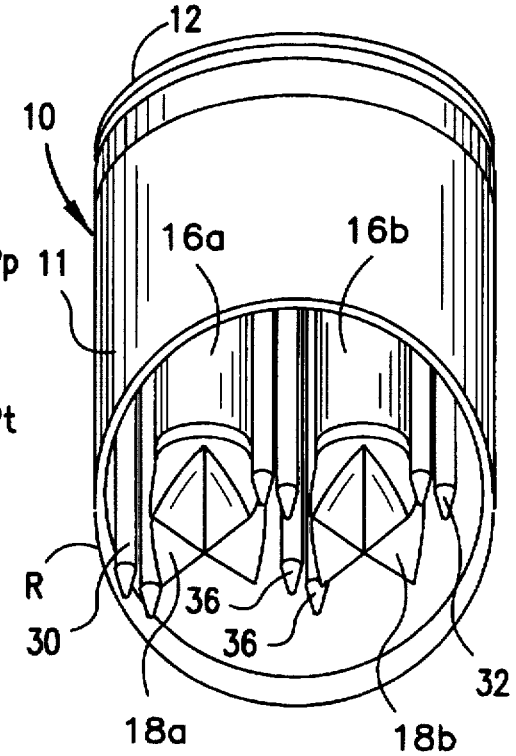
FIG. 6 is a bottom perspective view of the cleaning box as viewed from a position so as to illustrate the circle that is scribed by the plane of the cleaning box openings.

Moreover, as illustrated in FIG. 6, which shows a bottom view of the box 10 taken in a plane parallel to the angled opening 20, the open bottom 22 defines a circular cross-section. That is, the angled opening 20 scribes a circle R in the plane $P_o$ of the opening 20. Advantageously, the circular bottom opening 20 permits the use of a circular closure cap 24, described herein, which can greatly reduce the cost of manufacturing such a cap 24.

Referring now to FIG. 7, which illustrates a cross sectional view of the cleaning box 10, the body 11 is mounted to the mounting plate 12 which, in turn, is mounted to a portion of the apparatus 14, preferably a frame portion 26. The mounting plate 12 has a plurality of guide bars or guide pins 30, 32 that extend downwardly, at about two diametrically opposed corners, indicated by the arrows at 28 relative to the filling nozzles 18*a,b* (see FIG. 5). The guide pins 30, 32 facilitate proper positioning of the cartons C within the apparatus 14, and proper engagement of the filling nozzles 18*a,b* with the cartons C. In a current embodiment, two pairs of guide pins 30, 32 are associated with each filling tube 16*a,b*.

The guide pins 30, 32 of each pair are slightly spaced from one another defining a gap, as indicated at 34, and are positioned depending from the mounting plate 12 with their respective longitudinal axes $A_p$ parallel to a longitudinal axis $A_t$ of the filling tubes 16*a,b*. The axes $A_p$ of each pair of pins 30, 32 define a plane $P_p$ that is parallel to a plane $P_t$ traversing opposing corners 28 of the filling nozzle 18*a,b* and the carton C, when the carton C is positioned in engagement with a respective nozzle 18*a,b*. Thus, the two opposing corners of the carton C, adjacent to the pins 30, 32, are positioned essentially abutting the pins 30, 32, securing the carton C in place. The guide pins 30, 32 have tapered ends 36 to facilitate smooth receipt of the carton C, and to facilitate guiding the carton C in to place. The guide pins 30, 32 can be fit into openings 38 in the mounting plate 12 and subsequently welded thereto.

Figure 9:
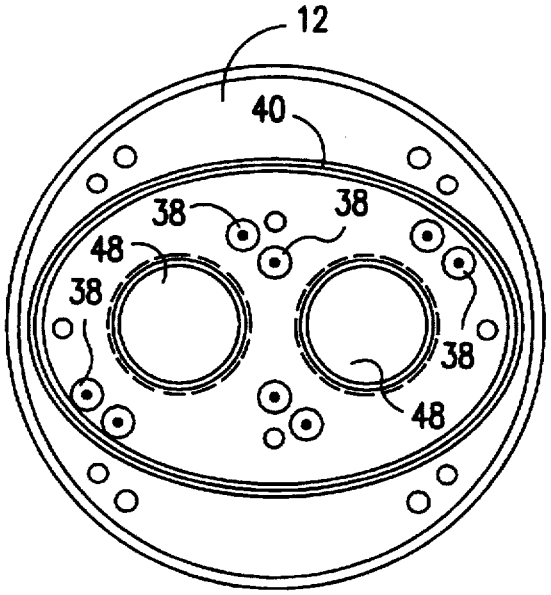
FIG. 9 is a bottom view of a mounting plate.

As shown in FIGS. 7 and 9, the mounting plate 12 can include an elliptical channel 40 formed therein at about the juncture of the mounting plate 12 and the body 11. In a current embodiment, the channel 40 is formed so as to receive an O-ring 42 or like sealing element to establish a seal at the body 11 to mounting plate 12 juncture. The cleaning box 10 has an outwardly extending flange 44 adapted for mounting the cleaning box 10 to the mounting plate 12. The mounting plate 12 and box 10 are mounted to the apparatus 14 by bolts 46 or like fasteners.

The mounting plate 12 has openings 48 therein which are adapted to receive the filling tubes 16*a,b*. The filling tubes 16*a,b* and mounting plate 12 can be commonly mounted to the apparatus 14 by, for example, a common mounting bracket 50, to facilitate alignment of the filling tubes 16*a,b* within the cleaning box 10. O-rings 52 can be positioned at the mounting plate 12 to filling tubes 16*a,b* junctures to establish seals between each tube 16*a,b* and the plate 12.

As best seen in FIGS. 11 and 12*a–c*, the cleaning box 10 has associated therewith a sealing closure cap 24. The cap 24 is configured to engage the bottom 22 of the cleaning box 10 to provide a sealed enclosure 56 for cleaning the filling tubes 16*a,b* and nozzles 18*a,b*. As previously discussed, because the opening 20 of the cleaning box 10 scribes a circle R, the cap 24 can have a complementary circular shape. As will be recognized by those skilled in the art, there are significant cost savings in manufacturing a circular cap 24 rather than an elliptical cap. This, in addition to the difficulties associated with manufacturing an out-of-round cap, provides a substantial advantage in the elliptical cleaning box 10 configuration over known cleaning box arrangements.

Figure 12C:
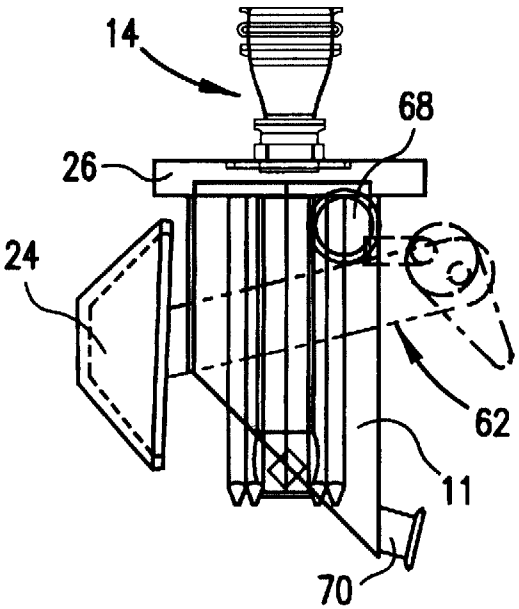
FIGS. 12*a–c* illustrate the cleaning box and closure cap mounted to a filling apparatus, the cleaning box being shown with the cap in the closed, partially opened and opened positions, respectively.
Figure 12B:
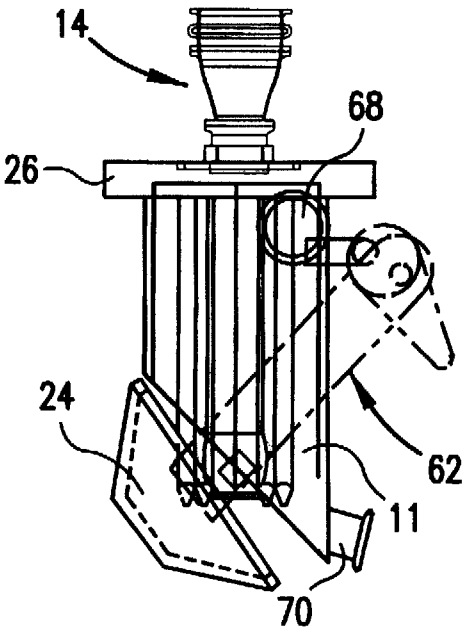
Figure 12A:
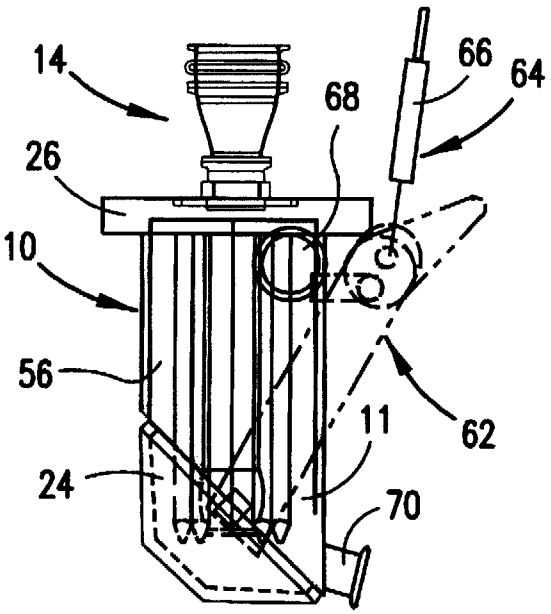

In a preferred arrangement, the cap 24 has a channel 58 formed therein, at about the periphery thereof, adapted to receive an O-ring 60 or like sealing element. Thus, when the cap 24 is in place on the cleaning box 10, a sealed cleaning environment 56 is provided. As illustrated in FIGS. 12*a–c*, the cap 24 can be positioned over the opening 20 in the cleaning box 10 by use of a positioning and locking device or system 62. Such a system 62 can include an actuated arrangement 64 using, for example, a pneumatically, electrically or mechanically driven actuator 66 to position the cap 24 over the opening 20. The cap 24 can also be provided with a peripheral flange (not shown) for clamping the cap 24 to the cleaning box 10 over the opening 20.

Referring to FIGS. 2 and 10–12*a–c*, the cleaning box 10 is shown with inlet and drain nozzles 68, 70 extending therefrom. When the cap 24 is positioned on the box 10 and the box 10 is sealed, a cleaning fluid, such as water, is pumped or otherwise input into the cleaning box 10. As shown, the inlet nozzle 68 can be tangentially positioned on the body 11. The tangential positioning of the nozzle 68 imparts a swirling motion to the cleaning fluid, thereby improving the scrubbing action of the fluid and enhancing cleaning of the filling tubes 16*a,b* and nozzles 18*a,b*.

In a preferred arrangement, as best seen in FIGS. 12*a–c*, the drain nozzle 70 can be configured having a downward slope. Likewise, the cap 24 can also be configured such that when the cap 24 is positioned over the cleaning box opening 20, it has a downward slope in the direction of the drain nozzle 70. Thus, cleaning liquid is less likely to pool or accumulate in the cap 24 and cleaning box 10, and drainage of the box 10 and cap 24 are enhanced. The cleaning box 10 can include additional nozzles, such as the exemplary spray nozzle 72 that is positioned to direct cleaning fluid between the filling tubes 16*a,b* to enhance cleaning between the tubes 16*a,b*.

As will be recognized by those skilled in the art, a plane can be drawn to intersect the longitudinal axis of any elliptical cylinder, through the major axis or diameter of the ellipse, such that the section defined by the plane scribes a circle. In the present cleaning box 10, the elliptical cylinder that defines the cleaning box 10 is configured such that the section defined by a plane at an angle $\alpha$ 45° relative to the longitudinal axis $A_c$ of the body 11 scribes a circle R. If, however, it is desired to form a different plane angle to scribe a circle, the relationship between the major and minor diameters of the ellipse relative to the plane angle can be established such that it defines a circle at that plane angle. All such angles and diameter relations are within the scope of the present invention.

Figure 10:
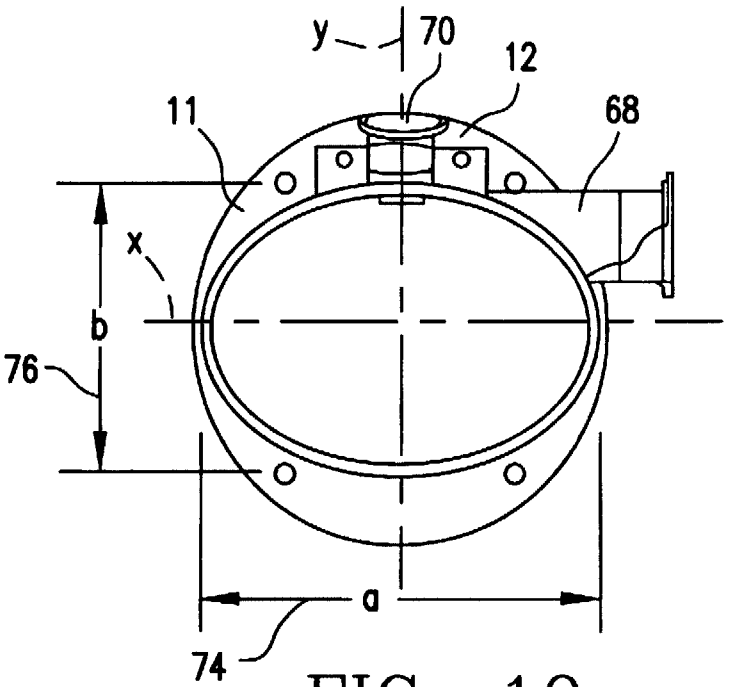
FIG. 10 is a bottom view of the cleaning box of FIG. 2.
Figure 11:
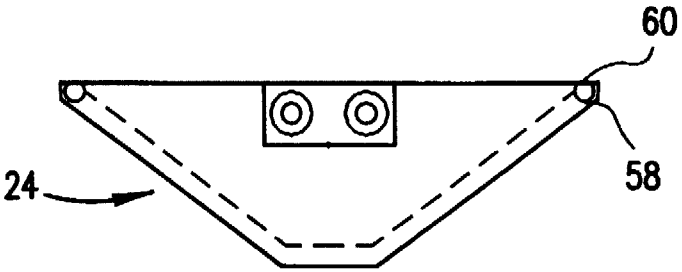
FIG. 11 is a side view of an exemplary closure cap used in conjunction with the cleaning box.
Figure 8:
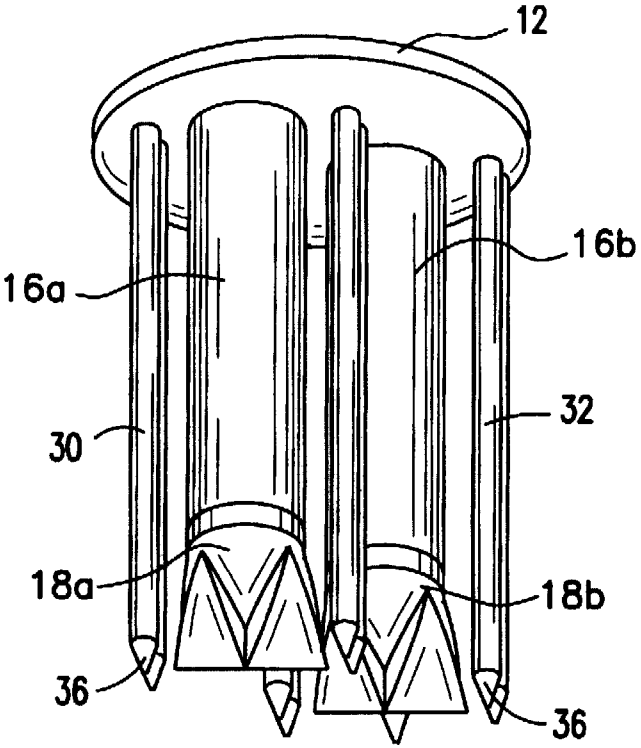
FIG. 8 is a side perspective view of a mounting plate having filling tubes and guide pins depending therefrom, illustrated with the cleaning box removed for clarity of illustration.

Referring to FIG. 10, wherein the present relationships are described relative to the elliptical cleaning box 10, the x-y coordinates of any point along the periphery of the ellipse are defined by the equation:

$$x^2/a^2+y^2/b^2=1, \text{ where}$$

a is the major diameter of the ellipse and lies along the x-axis, and b is the minor diameter of the ellipse and lies along the y-axis.

X and y can be no greater than a and b, respectively. In the current embodiment, the a and b values, as indicated by the arrows at 74 and 76, at the outer diameter of the elliptical cylindrical body 11 are 118.10 mm and 83.58 mm, respectively. Using these values for a and b, a section defined by a plane at an angle of 45° relative to the longitudinal axis $A_c$ scribes a circle. The relationship between the relative proportions of the major and minor diameters and the angle $\alpha$ of a plane section that scribes a circle, for any elliptical cylinder, can be represented as: $b=a \sin \alpha$.

Thus, from this relationship, any elliptical cylinder can be configured so that a section taken at a predetermined angle $\alpha$ relative to and intersecting the longitudinal axis, through the major axis of the ellipse, scribes a circle.

From the foregoing it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appended claims all such modifications as fall within the scope of the claims.

What is claimed is:

1. A filling assembly for a linear form, fill and seal packaging machine for processing a series of carton conveyed along a carton path, the filling assembly comprising:

two fill tubes adjacent each other disposed above the carton path, each of the tubes having a nozzle thereon, the two fill tubes filling a pair cartons simultaneously;

a plurality of guide pins disposed in relation to the two fill tubes for guiding a pair of cartons about the fill tubes;

a cleaning box substantially encompassing the two fill tubes and the plurality of guide pins, the cleaning box having an elliptical body having a longitudinal axis parallel to the filling tubes and perpendicular to the carton path, the elliptical body having a front half and a rear half, the cleaning box having a bottom opening angled to the longitudinal axis to define a circular cross section allowing for the visual perception of the nozzles, a portion of the filling tubes and a portion of each of the plurality of guide pins when viewed from a plane perpendicular to the longitudinal axis, the elliptical body extending from a mounting plate to a position below the two fill tubes on the rear half and to a position above the two fill tubes on the front half; a closure cap attached to the elliptical body and configured to coact with the opening to form a sealed cleaning box, the closure cap having a locking device for maintaining the closure cap in a sealed position engaged with the opening and an open position proximate to the front half of the elliptical body, the closure cap also having an actuator for automatic sealing and opening;

whereby during the filling operation the closure cap is in the open position and before the cleaning operation, the closure cap may be automatically closed thereby reducing contamination.

2.The filling assembly of claim 1 further comprising a drain nozzle disposed about the rear half of the lower end of the elliptical body of the cleaning box.

* * * * *